US005117647A

United States Patent [19]

Valbjorn

[11] Patent Number: 5,117,647

[45] Date of Patent: Jun. 2, 1992

[54] SERVO-CONTROLLED EXPANSION VALVE FOR A VOLATILE FLUID

[75] Inventor: Knud V. Valbjørn, Nordborg, Denmark

[73] Assignee: Danfoss A/S, Nordborg, Denmark

[21] Appl. No.: 683,514

[22] Filed: Apr. 8, 1991

Related U.S. Application Data

[63] Continuation of Ser. No. 542,532, Jun. 25, 1990, abandoned.

[30] Foreign Application Priority Data

Jul. 10, 1989 [DE] Fed. Rep. of Germany ..... 3922591

[51] Int. Cl.[5] ..... F25B 41/06

[52] U.S. Cl. ..... 62/222; 62/225; 251/30.05; 251/61.4; 251/63.6

[58] Field of Search ..... 62/222, 225; 251/30.01, 251/30.02, 30.05, 61.4, 63.6

[56] References Cited

U.S. PATENT DOCUMENTS

| | | | |
|---|---|---|---|
| 1,758,644 | 5/1930 | Betts et al. | 251/61.4 |
| 3,980,002 | 9/1976 | Jarman et al. | 281/30.05 X |
| 4,126,293 | 11/1978 | Zeuner et al. | 251/30.01 |
| 4,606,199 | 8/1986 | Gotzenberger | 251/30.01 X |

FOREIGN PATENT DOCUMENTS

| | | | |
|---|---|---|---|
| 52-58149 | 5/1977 | Japan | 62/225 |

*Primary Examiner*—Gerald A. Michalsky

*Attorney, Agent, or Firm*—Wayne B. Easton; Clayton R. Johnson

[57] ABSTRACT

The expansion valve has an inlet connection fluidly connected to a main valve while the main valve is fluidly connected through an outlet connection to the inlet of the evaporator of a refrigeration system. The main valve has a housing that includes a main valve chamber and a valve seat for fluidly connecting the inlet connection to the main valve chamber and a valve member movable between an open position and blocking fluid flow through the valve seat from the inlet connection to the valve chamber. A pressure operated servo arrangement is disposed in the main valve chamber for controlling the movement of the valve element and opens to the pressure outlet of a pilot valve arrangement. The pilot valve arrangement is disposed in a branch path that opens to inlet connection and to the valve chamber downstream of the valve set for controlling the fluid pressure at the pressure outlet.

14 Claims, 2 Drawing Sheets

SERVO-CONTROLLED EXPANSION VALVE FOR A VOLATILE FLUID

This application is a continuation application of Ser. No. 07/542,532, filed Jun. 25, 1990, now abandoned.

The invention relates to a servo-controlled expansion valve for a volatile fluid, particularly for use in an electronically controlled injection of refrigerant in the evaporator of refrigeration installations, comprising a main valve which is actuatable by a controlled pilot valve arrangement by way of a servo arrangement in which the fluid serves as pressure medium.

In a known expansion valve (DE-PS 27 49 250, FIG. 3, which corresponds to U.S. Pat. No. 4,475,686 to Huelle et al), the pilot valve is controlled by way of a diaphragm which, in turn, bounds a chamber in which there is a medium having a liquid and a vapour phase. This medium is heated by an electric heater in the liquid, so that a controlled pressure is reached which opens the pilot valve against the force of a spring. When the pilot valve opens, liquid refrigerant flows from the inlet of the expansion valve through a throttle orifice in an operating chamber bounded by a servo piston which actuates the closure member of the main valve, and from there through a throttle orifice in the servo piston and through the pilot valve orifice to the evaporator. The differential pressure thereby created by the refrigerant across the servo piston sets the position of the servo piston and thus of the closure member of the main valve, i.e. the degree of opening of the main valve.

Under certain conditions, it can happen that the refrigerant evaporates in the operating chamber. By reason of the compressibility of the refrigerant vapour, the servo piston could oscillate, leading to corresponding oscillations of the closure member of the main valve. The problem is aggravated because refrigerant vapour can also form across the servo piston if the temperature of the refrigerant is near the boiling point and a pressure drop has been brought about by the throttle orifice in the servo piston, so that the servo piston strikes a vapour cushion in both directions of movement.

The invention is based on the problem of providing a servo-controlled expansion valve which has less tendency to oscillate.

This problem is solved in an expansion valve of the aforementioned kind in that the servo arrangement is thermally connected to the outlet side of the main valve.

Lower temperatures obtain on the outlet side of the main valve because of expansion. These lower temperatures cool the fluid in the servo arrangement, so that no vapour can form here and the fluid is present as a liquid. The pressure build-up and thus the control take place solely through this liquid, which is incompressible. This considerably reduces the tendency of the closure of the main valve to oscilate.

In a preferred embodiment, the servo arrangement is disposed in a chamber downstream of the main valve. The chamber is traversed by the fluid that has passed through the main valve. Since a lower temperature obtains on the outlet side of the main valve, i.e. downstream of the main valve, than on the inlet side, the lower temperature likewise obtains in the chamber, which cools the servo arrangement.

In a preferred embodiment, the servo arrangement comprises a servo cylinder in which a piston connected to a valve element of the main valve bounds an operating chamber which is subjected to a pressure controllable by the pilot valve arrangement. In another preferred embodiment, the servo arrangement comprises a diaphragm which is connected to the valve element of the main valve and bounds an operating chamber which is subjected to a pressure controllable by the pilot valve arrangement. Diaphragm is understood to mean any deformable bounding wall of the operating chamber. The operating chamber can therefore also be bounded by bellows. Since the servo arrangement is thermally connected to the outlet side of the main valve, i.e. to the cold side, the operating chamber is cooled from the outside. No vapour can form in the operating chamber. This avoids oscillations.

Advantageously, the pilot valve arrangement has in series between the inlet and outlet of the expansion valve a fixed and a controlled variable throttle between which the pressure controllable by the pilot valve arrangement can be derived. In one embodiment, the variable throttle may be disposed upstream of the fixed throttle and in another embodiment the fixed throttle upstream of the variable throttle. By changing the degree of opening of the variable throttle, which may be formed by a controllable valve, the pressure can be set to a large range of values between the inlet and outlet pressures.

In an alternative embodiment, the pilot valve arrangement has in series between the inlet and outlet of the expansion valve two controlled variable throttles between which the pressure controllable by the pilot valve arrangement can be derived. This embodiment of the pilot valve arrangement is more expensive to construct but the control pressure produced by the pilot valve arrangement can thereby be set to practically every value between the inlet and outlet pressures of the expansion valve.

In a third alternative, the pilot valve arrangement is in the form of a controlled three-way valve communicating with the inlet and outlet of the expansion valve and the operating chamber of the servo arrangement. The inlet thus communicates with the fluid, such as the refrigerant, in front of the expansion valve where there is a higher temperature than at the outlet of the expansion valve, to which one outlet of the three-way valve is connected. The second outlet of the three-way valve is connected to the operating chamber of the servo arrangement.

One thereby likewise achieves favourable temperature influencing of the three-way valve, so that here, too, no vapour can form substantially because of the throttling effect of the outlet leading to the operating chamber.

Advantageously, the pilot valve arrangement is electrically controllable. For this purpose, the variable throttles may be in the form of electrically or electromagnetically actuatable valves. Similarly, the three-way valve may have one or two electrically actuatable valves at its inlets or outlets. To achieve a throttling effect, the valves may also be opened and closed in cycles. Direct electric control is rapid and can be easily effected with the aid of known control means.

Preferably, the chamber and the outlet of the main valve are in a metal housing. Since there is a lower temperature on the outlet side of the main valve and metal is a good thermal conductor, this ensures that the chamber is cooled directly by the fluid on the outlet side. Of course the inlet of the main valve must also somehow open into the housing. However, by means of a suitable conduit system, one can ensure that the temperature influence by the outlet is greater.

It is in this case preferable for the pilot valve arrangement in the housing is disposed at the housing parts bounding the chamber. This ensures that the pilot valve arrangement is cooled not only by the fluid around it but also by the cold flow through the metal housing.

Preferred examples of the invention will now be described with reference to the drawing, wherein.

Figure 3:
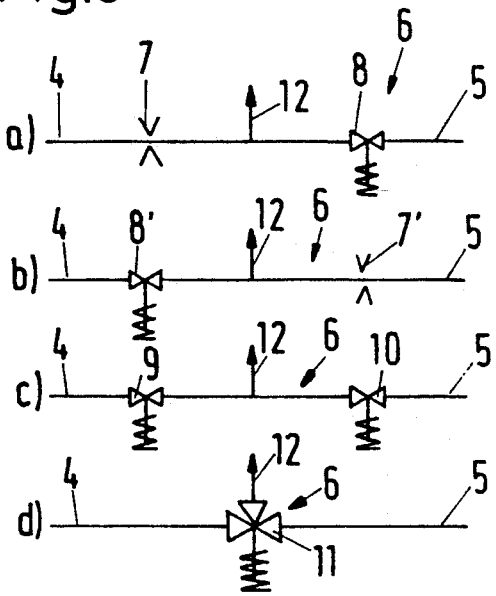
FIG. 3 illustrates various embodiments of a pilot valve arrangement.

An expansion valve 20 comprises an inlet connection 1 which is connected to the outlet of the condenser 41 of a refrigeration installation, and an outlet connection 2 for a volatile liquid which is connected to the inlet of the evaporator 40 of the system, separated by a main valve 21 which is bridged by a branch path 3. The branch path 3 has a branch inlet 4 branching off from the inlet connection 1. The branch path allows the liquid to flow to the outlet connection 2 through its branch outlet 5. A pilot valve arrangement 6 is disposed in the branch path 3.

There are various constructions for the pilot valve arrangement, as will be explained in conjunction with FIGS. 3 and 4. Two throttle points are provided in series between the branch inlet 4 and branch outlet 5. In FIG. 3*a*, these are a fixed throttle 7 and a variable adjustable throttle 8 which can, for example, be formed by a magnetic valve. Between the two throttling points, a control pressure $P_S$ can be derived at a control pressure outlet 12. This pressure is adjustable between the condenser pressure $P_K$ at the branch inlet 4 and the evaporator pressure $P_V$ at the branch outlet 5. If the variable throttle 8 is closed, the pressure $P_S$ at the control pressure outlet is equal to the pressure at the branch inlet. On the other hand, if the adjustable throttle 8 is opened completely, the pressure $P_S$ at the control pressure outlet 12 depends on the amount of fluid flowing through.

In FIG. 3*b*, the sequence of fixed and variable throttle is reversed. In this case, behind the branch inlet 4 there is first a variable throttle 8' and, downstream thereof, a fixed throttle 7'. If the variable throttle 8' is closed, the evaporator pressure $P_V$ obtains at the control pressure outlet 12. If the variable throttle 8' is opened, the pressure $P_S$ at the control pressure outlet 12 depends on the amount of fluid flowing through.

In FIG. 3*c*, both throttles 9, 10 are variable. One can thereby ensure that the pressure at the control pressure outlet 12 in the valve bottom wall 43 of the housing 34 can assume the value of the pressure $P_K$ at the branch inlet 4 as well as the pressure $P_V$ at the branch outlet 5. Both throttles, which may be electrically actuatable valves, can be operated independently of each other.

FIG. 3*d* shows a fourth embodiment in which the pilot valve arrangement consists substantially of a three-way valve 11. The function of this three-way valve corresponds to the function of one of those shown in FIGS. 3*a* to 3*c*, depending on its construction. It could also be the case that, without a pressure drop at its inlet, the three-way valve divides the inlet pressure amongst the control outlet 12 and branch outlet 5.

Figure 4:
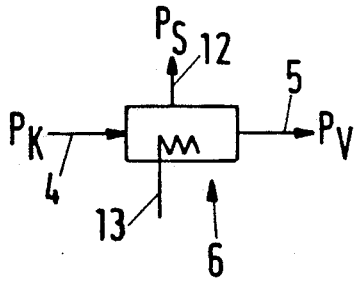
FIG. 4 shows a symbol for the pilot valve arrangement.

FIG. 4 illustrates a standard symbol for all the pilot valve arrangements of FIG. 3, the control pressure $P_S$ at the control pressure outlet 12 setting itself between the value $P_K$ at the branch inlet 4 and the value $P_V$ at the branch outlet 5 as a result of a signal at one control inlet 13, for example an electric connection. This symbol is employed in FIGS. 1 and 2 in order to illustrate the pilot valve arrangement.

The main valve 21 of the expansion valve 20 contains in a housing 34 a valve seat 22 against which a closure member 23 is movable. When the closure member 23 lies against the valve seat 22, the main valve 21 is closed. The movement of the closure member 23 is controlled by a servo arrangement 24 by way of a tappet 25.

Figure 1:
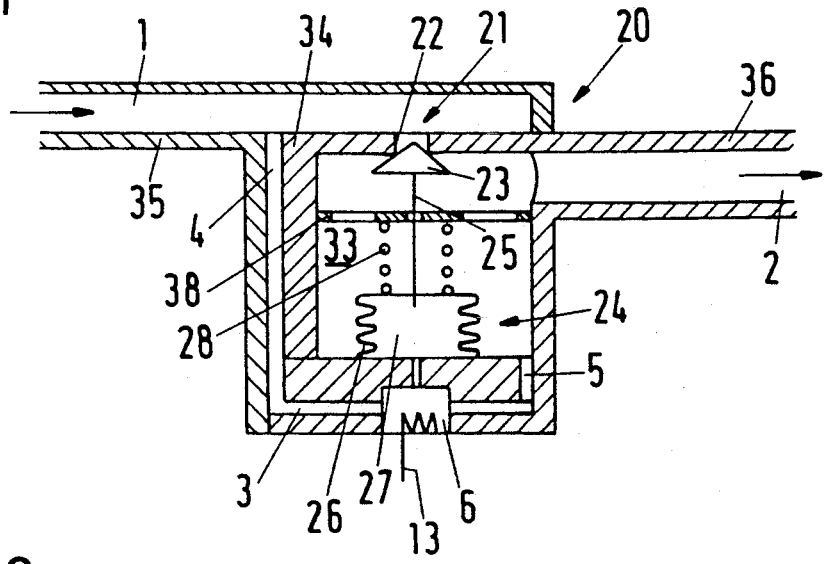
FIG. 1 illustrates a first embodiment of expansion valve.

The servo arrangement 24 according to FIG. 1 comprises bellows 26 bounding an operating chamber 27. The bellows are compressed under the force of a spring 28 supported against an abutment 38 which is fixed with respect to the housing, whereby the closure member 23 moves to the open position of the main valve 21. The operating chamber 27 is impinged by the control pressure $P_S$ from the control pressure outlet 12 of the pilot valve arrangement 6. The control pressure $P_S$ thus acts against the force of spring 28 to bring the main valve 21 to the closed position. The servo arrangement 24 is disposed in a chamber 33 located on the outlet side of the main valve 21, i.e. traversed by expanded and thus cooled liquid. The chamber 33 is in direct communication with the outlet connection 2. This ensures that the fluid that has passed through the main valve 21 also flows around the servo arrangement before it leaves the expansion valve 20 through the outlet connection 2. Since the fluid on the outlet side of the main valve 21, i.e. in the chamber 33, has a lower temperature than at the inlet connection 1, no vapour can form in the operating chamber 27 which is likewise filled with fluid by way of the pilot valve arrangement 6. The fluid in the operating chamber 27 is, through external cooling, held at substantially the same temperature as the fluid in the chamber 33. At this temperature, however, the fluid is in its liquid phase. Since the liquid is incompressible, no oscillations can arise that might become disturbingly noticeable as oscillations of the closure member 23.

For a still better thermal coupling of the servo arrangement to the cold fluid at the outlet side of the expansion valve, the housing 34 is made of metal. The servo arrangement 24 is secured to the metal housing. It will be known that metal is a good thermal conductor, so that the housing 34 and thus the servo arrangement 24 will not be able to store heat. Instead, the heat is dissipated immediately. Naturally, the relatively warm fluid must be fed to the expansion valve 20 by way of an inlet connector 35. The inlet connector 35 should therefore be thermally uncoupled from the housing 34, for example by an interposed thermal insulator (not shown). On the other hand, an outlet connector 36 forming the outlet connection 2 may be made in one piece with the metallic housing 34 because the outlet connector 36 is cooled by the fluid on the outlet side of the expansion valve 20. From a constructional point of view, the conduit system can be made so that the metal housing comes into contact with the cooler fluid on the outlet side of the expansion valve 20 over a larger area than with the warmer fluid on the inlet side. This ensures that a cooling effect is exercised on the servo arrangement 24 not only by way of the chamber 33 but also by way of the metal housing 34. Although the servo arrangement 24 is illustrated as bellows in the present example, the operating chamber may also be surrounded by a solid body, for example a cylinder closed at the end by a diaphragm. The closure member 23 of the main valve 21 has to execute only relatively small movements which can also be produced by a diaphragm.

Figure 2:
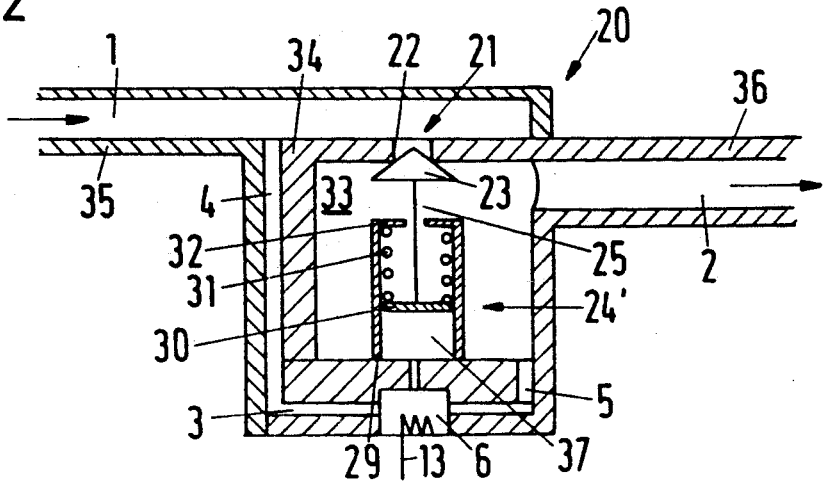
FIG. 2 illustrates a second form of expansion valve.

FIG. 2 shows a different example of a servo arrangement. Parts corresponding to those in FIG. 1 have been provided with the same reference numerals. The servo arrangement 24' comprises a cylinder 29 which, together with a piston 30, bounds an operating chamber 37. The piston 30 is connected to the tappet 25 of the closure member 23. The piston 30 works against the force of a spring 31 which is supported against an abutment 32 fixed with respect to the cylinder. The operating chamber 37 of the servo arrangement 24' communicates with the control pressure outlet 12 of the pilot valve arrangement 6. Fluid entering the pilot valve arrangement 6 through the branch inlet 4 enters the branch outlet 5 and also through the control pressure outlet 12 the operating chamber 37. This fluid is in the liquid phase but near its boiling point. The throttling effect of the pilot valve arrangement 6 could therefore cause it to vaporise. However, since the cylinder 29 is arranged in the chamber 33 which is traversed by the cooler fluid, the fluid in the operating chamber 38 is also cooled so that the temperature drops to far below the boiling point. The danger of forming vapour is therefore eliminated. The operating chamber 37 therefore remains filled with fluid in the liquid phase, whereby oscillations are avoided.

Figure 5:
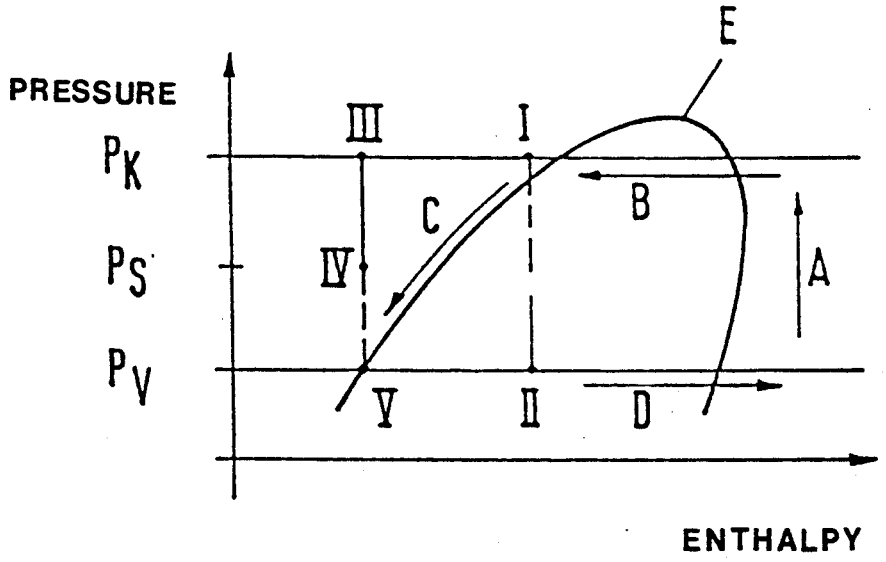
FIG. 5 shows a pressure-enthalpy diagram.

FIG. 5 shows a pressure-enthalpy diagram illustrating the function of the illustrated servo-controlled expansion valve. The curve E represents the relationship between enthalpy and pressure, the liquid being at boiling point. Below the curve E, the refrigerant is present as saturated vapour. Along the arrow A, compression of the saturated refrigerant vapour takes place from a pressure $P_V$ to a higher pressure $P_K$. At a constant pressure $P_K$, condensation takes place along the arrow B up to the point I which represents the condition of the refrigerant at the outlet of the condenser and thus at the inlet 1 of the expansion valve 20. From the point I, the expansion valve 20 brings about expansion of the refrigerant to the point D along the arrow C, the pressure dropping from the condenser pressure $P_K$ to the evaporator pressure $P_V$. The enthalpy will be reduced correspondingly. The point IV corresponds to the condition of the refrigerant in the servo arrangement 24, 24' having a pressure $P_S$ and an enthalpy corresponding to the point V. Since this point lies above the limit between the liquid phase and gaseous of the refrigerant the refrigerant in the servo arrangement 24, 24' will always be in the liquid phase. At a constant refrigerant pressure $P_V$ after the point V, heating takes place by the absorption of heat from the surroundings in the evaporator along the arrow D, whereby the circuit is closed. It will be evident that, if the refrigerant in the servo arrangement is kept cooled, the formation of vapour can here be supressed with certainly, thereby producing a "stiff" regulating system.

The pressure $P_S$ set by the pilot valve arrangement 6 between the two throttling points is determined by the following equation:

$$P_S = P_V + \frac{\text{spring force}}{\text{bellows area}}$$

In the throttling point adjacent to the outlet 5, e.g. the second throttle 6, 7' or 10, the fluid is throttled from point IV ($P_S$) to point V ($P_V$), which takes place without the formation of vapour because the servo arrangement 24, 24' as well as the associated conduits and the bellows 26 or cylinder 29 are thermally coupled to the lower temperature.

I claim:

1. A refrigeration system having an evaporator that has an inlet, and a servo-controlled expansion valve for volatile fluid for use in an electronically controlled injection of refrigerant to the evaporator, the expansion valve including a main valve having a housing, the housing having an inlet for the volatile fluid of a given temperature to flow through, an outlet side fluidly connected to the evaporator inlet, and means defining a main valve chamber for having the volatile fluid flow therethrough at a lower temperature than the given temperature and a valve seat that opens to the valve chamber and to the housing inlet, a valve element movable between a valve seat blocking position to block fluid flow from the housing inlet to the valve chamber and a valve seat opening position, a servo arrangement thermally connected to the housing outlet side and operated by the pressure of fluid therein for controlling the movement of the valve element and thereby the flow of fluid through the valve seat to the valve chamber, the servo arrangement being disposed in the main valve chamber downstream of the valve seat and having servo arrangement means for defining an operating chamber that at least in part is surrounded by and in thermal contact with the fluid in the main chamber for holding the temperature in the operating chamber at substantially the same temperature as that in the main chamber, and a pilot valve arrangement fluidly connected to the main valve inlet and to one of the main valve chamber and the outlet side for controlling the fluid pressure in the servo arrangement, the pilot valve arrangement having a control pressure outlet opening to the servo arrangement for conducting fluid into and out of the servo arrangement operating chamber.

2. The apparatus of claim 1 wherein the servo arrangement comprises a piston cylinder combination having a piston connected to the valve element for moving the valve element, and a cylinder having the operating chamber, the pressure outlet opening to the operating chamber, the cylinder being located in the main valve chamber.

3. The apparatus of claim 1 wherein the servo arrangement comprises a diaphragm connected to the valve element, the diaphragm defining the operating chamber, the operating chamber opening to the pressure outlet.

4. The apparatus of claim 1 wherein the pilot valve arrangement comprises an electrically controllable unit.

5. The apparatus of claim 1 wherein the housing, including the housing outlet, are made of metal.

6. The apparatus of claim 1 wherein cold fluid flows within the housing, the housing is made of metal and the pilot valve arrangement is disposed relative to the housing for being cooled by fluid flow through the housing.

7. The apparatus of claim 1 wherein the pilot arrangement comprises a fixed throttle and a controlled variable throttle connected in series between the housing inlet and the outlet side for controlling the fluid pressure at the pressure outlet.

8. The apparatus of claim 1 wherein the pilot arrangement comprises two controlled variable throttles connected in series between the housing inlet and the outlet side for controlling the fluid pressure at the pressure outlet.

9. The apparatus of claim 1 wherein the pilot valve arrangement comprises a three-way valve fluidly connected between the housing inlet, the outlet side and the pressure outlet.

10. A refrigeration system comprising an expansion valve having an inlet connection, an outlet connection, a main valve fluidly connected between the inlet and outlet connections and having a housing, the housing having a main valve chamber and a valve seat in fluid communication with the inlet connection and the main valve chamber and a valve element movable between a position for blocking fluid flow through the valve seat from the inlet connection to the valve chamber and an open position, branch means for providing a fluid flow branch path that includes a branch inlet branching off from the inlet connection for conducting fluid from the inlet connection, a branch outlet allowing fluid flow to the outlet connection, and a controllable pilot valve arrangement having a pressure outlet and being disposed in the branch path for controlling the flow of fluid between the branch inlet, the pressure outlet and the branch outlet, the pilot valve arrangement having pilot means for applying a controllable pressure at the pressure outlet, and a servo arrangement in thermal contact with the fluid in the main valve chamber downstream of the valve seat and opening to the pressure outlet for controlling the movement of the valve element in response to the pressure at the pressure outlet, the servo arrangement having means extending within the main valve chamber and defining an expandable operating chamber for having fluid flow thereinto and thereout through the pressure outlet and at least in part being surrounded by fluid in the main valve chamber that is in contact therewith.

11. A refrigeration system according to claim 10 wherein the housing has a bottom wall, the bottom wall having the pressure outlet opening therethrough.

12. A refrigeration system accord to claim 10 wherein the pilot valve includes one of a three-way valve and a variable throttle.

13. A refrigeration system according to claim 10 wherein the pilot valve arrangement comprises an electrically controlled valve for controlling fluid flow from the branch inlet to at least one of the pressure outlet and the branch outlet.

14. A refrigeration system according to claim 13 wherein the pilot valve arrangement is disposed adjacent to the main valve chamber and is at least in part in the housing, the housing and the outlet connection being made of metal.

* * * * *